United States Patent [19]

Aragona

[11] Patent Number: 4,512,569

[45] **Date of Patent: * Apr. 23, 1985**

[54] PUNCHING BAG APPARATUS AND ADJUSTABLE SUPPORTING MEANS

[76] Inventor: Louis Aragona, 11 Scheiber Ter., Cedar Grove, N.J. 07009

[ * ] Notice: The portion of the term of this patent subsequent to Dec. 21, 1999 has been disclaimed.

[21] Appl. No.: 516,582

[22] Filed: Jul. 25, 1983

[51] Int. Cl.[3] ..... A63B 69/22

[52] U.S. Cl. ..... 272/78; 272/900

[58] Field of Search ..... 272/76–78, 272/62, DIG. 4, 900; 273/55 R

[56] References Cited

U.S. PATENT DOCUMENTS

| | | | |
|---|---|---|---|
| 4,157,179 | 6/1979 | Ecklor | 272/DIG. 4 |
| 4,364,558 | 12/1982 | Aragona | 272/78 |
| 4,405,127 | 9/1983 | Miller | 272/62 |

FOREIGN PATENT DOCUMENTS

| | | | |
|---|---|---|---|
| 1274573 | 9/1961 | France | 272/78 |
| 18305 | of 1910 | United Kingdom | 272/78 |

*Primary Examiner*—Richard J. Apley
*Assistant Examiner*—S. R. Crow
*Attorney, Agent, or Firm*—Anthony F. Cuoco

[57] ABSTRACT

The apparatus disclosed includes a punching bag member having a body portion and a neck portion. An adjustable supporting means engages the neck portion for supporting the punching bag member between a pair of vertical members such as in a door frame or the like. The arrangement is such that the adjustable supporting means engages brackets on the vertical members and supports the punching bag member so that if offers resistance to the user when the body portion is struck and automatically returns to its normal position.

6 Claims, 10 Drawing Figures

PUNCHING BAG APPARATUS AND ADJUSTABLE SUPPORTING MEANS

BACKGROUND OF THE INVENTION

Punching bags are generally constructed of an expensive leather exterior which covers an inflated rubber bladder. These bags require special attachments which are inserted into a swivel hook bag holder permanently affixed to a platform or the like from which the bag is suspended. Apparatus of this type is expensive and is directed toward the experienced user.

A need exists for a punching bag and supporting means directed toward the inexperienced user and featuring simplified construction. U.S. Pat. No. 4,364,558 issued on Dec. 21, 1982 to the present inventor accomplishes this purpose by providing punching bag apparatus and supporting means whereby a punching bag member is supported between two vertical members. The present invention is an improvement over the invention disclosed and claimed in the aforenoted U.S. Pat. No. 4,364,558 in that the supporting means is adjustable to accommodate varying spaces between the vertical members, and is more rigid to provide steadier and firmer punching bag performance.

Accordingly, it is an object of the present invention to provide punching bag apparatus and adjustable supporting means particularly directed to the inexperiened user which is economical and simple to install, and enhances the punching bag performance.

SUMMARY OF THE INVENTION

This invention contemplates punching bag apparatus including means for adjustably supporting the punching bag between a pair of vertical members such as in a door frame or the like. A punching bag member which may be molded or otherwise fabricated of a suitable plastic material so as to form a substantially hollow member has a body portion which is struck by the user and a neck portion which is adapted to engage a supporting member which may be a pair of wires or other suitably resilient members twisted together for providing a resilient, open central portion for engaging the punching bag member and extending therefrom on both sides thereof. The supporting member is adapted at its ends for being supported by a frame. A pair of arms support the frame and are adjustable relative thereto to accommodate varying spaces between the vertical members which carry brackets for supporting the arms. The arrangement is such that the punching bag member is supported so that resistance is offered to the user when the body of the member is struck, and the member automatically returns to its normal position when the striking is discontinued.

DETAILED DESCRIPTION OF THE INVENTION

Figure 1:
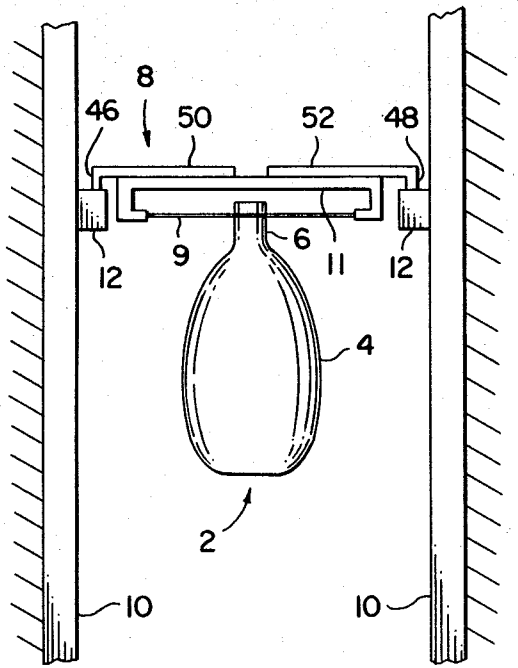
FIG. 1 is a diagrammatic representation generally showing punching bag apparatus and adjustable supporting means according to the invention.

With reference first to FIG. 1, the invention disclosed includes a punching bag member designated generally by the numeral 2 and including a body portion 4 and a neck portion 6. Punching bag member 2 may be molded or otherwise fabricated from a suitable, thin gauge plastic material such as polyethylene or the like for providing a relatively rigid hollow member. In these respects member 2 is not unlike commercially available plastic containers which contain soft drinks and other liquids for sale to the consumer.

Neck portion 6 of punching bag member 2 is supported by adjustable supporting means designated generally by the numeral 8 so that the bag member extends substantially normal to the supporting means and substantially parallel to a door frame 10, and substantially central thereto. Supporting means 8 is received by brackets or the like 12 secured at the opposite sides of door frame 10. Supporting means 8 will be described in substantial detail with reference to FIGS. 4, 5, 6 and 10.

In this connection it is noted that the invention is described as being supported in a door frame, but it will be understood that it can be supported by any pair of vertical members in substantially parallel relation to each other, as the case may be, with the space between the vertical members varying as will hereinafter be understood.

Figure 3:
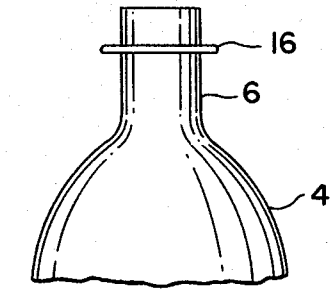
FIG. 3 is a diagrammatic representation showing another embodiment of the invention, wherein the neck portion of the punching bag member has a flange for engaging the supporting means.
Figure 2:
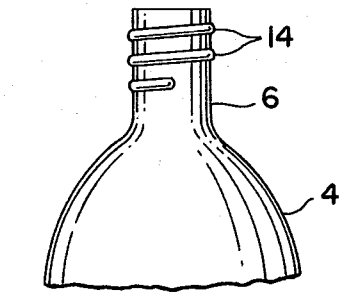
FIG. 2 is a diagrammatic representation showing one embodiment of the invention, wherein the neck portion of a punching bag member shown in FIG. 1 has protrusions thereon for engaging the supporting means.

Supporting means 8 includes a supporting member 9 for supporting neck portion 6 of punching bag member 4 which is adapted for receiving supporting member 9 as shown with reference to FIGS. 2 and 3. Supporting member 9 is specifically shown in FIG. 4.

Thus, with reference to FIG. 2, neck portion 6 of punching bag member 4 is seen as having a plurality of protrusions 14 extending circumferentially around the neck, and in this regard the neck portion resembles the neck portion of the aforenoted liquid containers, whereby a cap is screwed on to the extending protrusions or threads to close and seal the containers.

With reference to FIG. 3, neck portion 6 of punching bag member 4 is seen as including a flange 16 disposed substantially below the top of the neck and extending circumferentially therearound.

Figure 4:
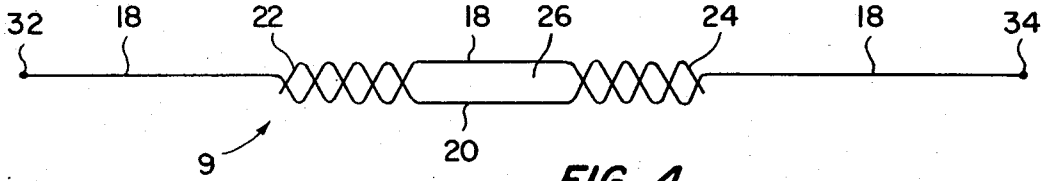
FIG. 4 is a diagrammatic top view representation of a supporting member for the punching bag member according to the invention.
Figure 7:
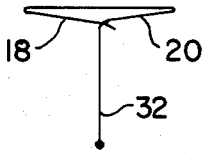
FIG. 7 is an end view of the supporting member, the top view of which is shown in FIG. 4.

With reference to FIG. 4, supporting member 9 is seen as including a pair of resilient members 18 and 20, and which members may be wires of suitable gauge and material so as to have the appropriate resiliency for purposes which will hereinafter become evident. Wires 18 and 20 are arranged so that they are twisted together to form a unitary member at 22 and 24, with the wires being in spaced relation at their central portion 26. One of the wires such as 18 extends oppositely from the twistings at 22, 24. Wire 18 terminates at ends 32 and 34, and which ends may be bent substantially normal to the extending portions of the wire as shown in FIG. 7.

Thus, with continued reference to FIG. 4, central portion 26 of supporting member 9 coacts with protrusions 14 on neck portion 6 as shown in FIG. 2, or with flange 16 as shown in FIG. 3, to support punching bag member 2, and ends 32 and 34 are supported as will be hereinafter described with reference to FIG. 10.

Figure 5:
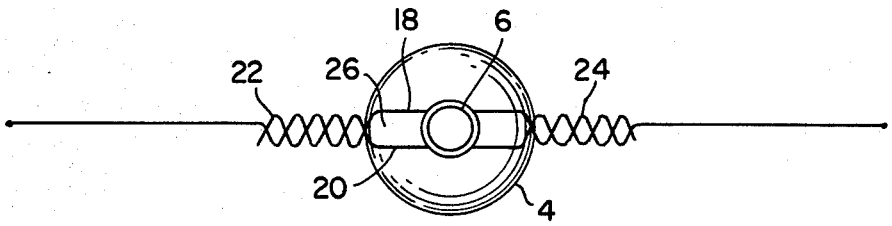
FIG. 5 is a diagrammatic top view representation showing the neck portion of the punching bag member in accordance with FIG. 2 engaging the supporting member as shown in FIG. 4.
Figure 6:
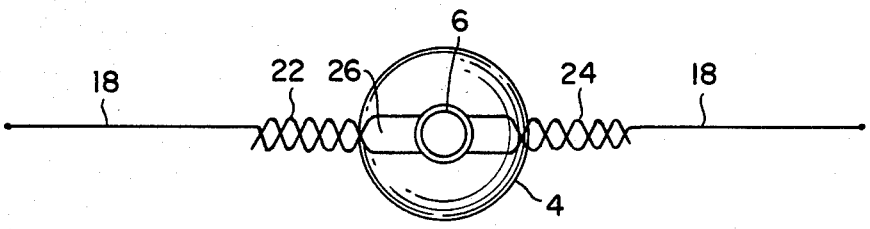
FIG. 6 is a diagrammatic top view representation showing the neck portion of the punching bag member in accordance with FIG. 3 engaging the supporting member as shown in FIG. 4.

With reference to FIGS. 5 and 6, central portion 26 of supporting element 9 may be spread apart either by the fingers of the user or with an appropriate tool such as a screw driver or the like. Thereafter, the central portion is slipped over protrusions 14 (FIG. 2) or flange 16 (FIG. 3), after which the two wires 18 and 20 forming central portion 26 are released so as to snap under the protrusions or the flange as the case may be, whereby punching bag member 4 is supported with its axis substantially normal to the axis of supporting element 9 when the member is at a level or horizontal position as shown in FIG. 1. Member 9 is supported by a frame 11 as will be hereinafter described with reference to FIG. 10.

Figure 8:
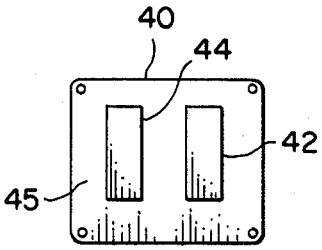
FIG. 8 is a front plan view of a bracket for receiving adjustable arms shown in FIG. 10, and whereby the punching bag member is supported between vertical members such as in a door frame or the like. p
Figure 9:
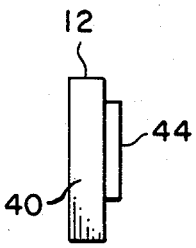
FIG. 9 is an end view of the bracket shown in FIG. 8.

With further reference to FIG. 1, brackets 12, which may be in the form shown in FIGS. 8 and 9, have a base 40 and a pair of members 42 and 44 forming a channel 45, and which channel 45 receive ends 46 and 48 of arms 50 and 52 respectively. Arms 50 and 52 adjustably support frame 11 as will be described with reference to FIG. 10. Brackets 12 for this purpose may be of a metallic or plastic material as will now be understood by those skilled in the art.

Figure 10:
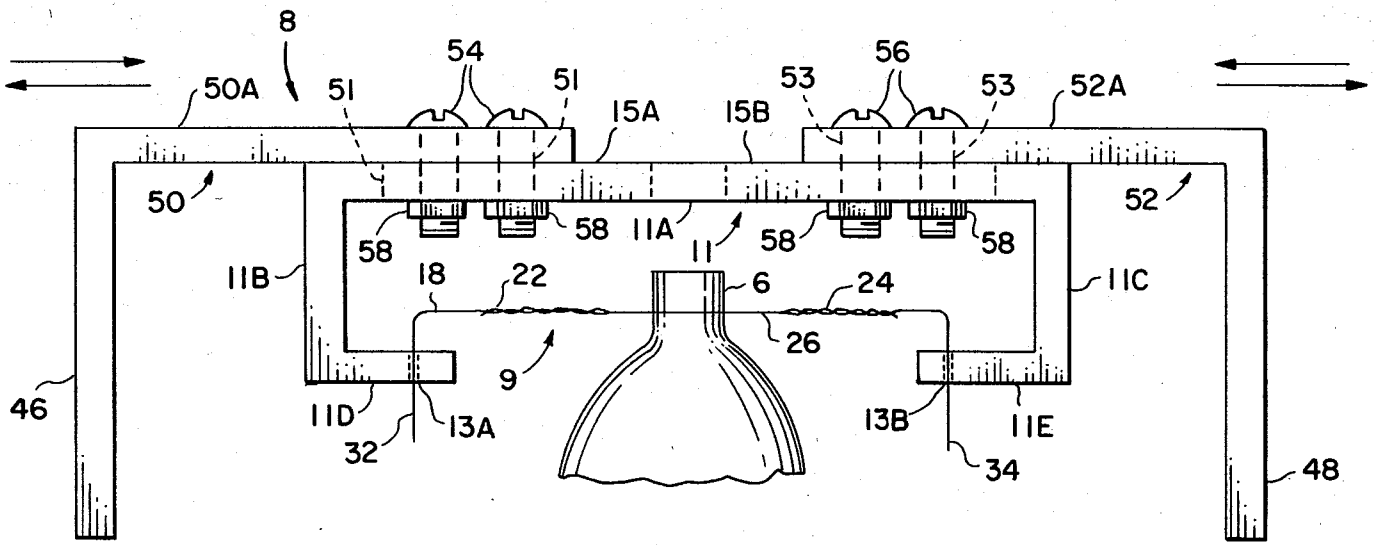
FIG. 10 is a diagrammatic front plan view showing in substantial detail punching bag apparatus and adjustable supporting means according to the invention.

With particular reference now to FIG. 10, wherein supporting means 8 is shown in substantial detail, bracket 11 has a substantially horizontally disposed base 11A and a pair of legs 11B and 11C extending normal to the base at its ends. Legs 11B and 11C terminate in lips 11D and 11E, respectively, and which lips are parallel to base 11A. Lips 11D and 11E carry through holes 13A and 13B, respectively. Base 11A of frame 11 has elongated slots 15A and 15B on either side of the center of the base.

Arms 50 and 52 have substantially horizontally disposed bases 50A and 52A, respectively, with arm ends 46 and 48 extending substantially normal to bases 50A and 52A, respectively. Base 50A carries a pair of through holes 51 and base 52A carries a pair of through holes 53.

Thus, base 50A of arm 50 and base 52A of arm 52 are supported on base 11A of bracket 11, with holes 51 and 53 aligned with slots 15A and 15B, respectively. Bolts or the like 54 and 56 extend through holes 51 and slot 15A, and through holes 53 and slot 15B, respectively, being secured therein by nuts 58.

With nuts 58 loose on bolts 54 and 56, arms 50 and 52 may be displaced away from or toward each other as shown by the arrows in the Figure to accommodate various spaces between vertical members 10 (FIG. 1). Upon such displacement, bolts 54 and 56 traverse slots 15A and 15B, respectively.

When arms 50 and 52 are in a position so that legs 46 and 48 thereof are received by brackets 12 (FIG. 1), nuts 58 are tightened against bolts 54 and 56 to secure bracket 11 to the arms.

Ends 32 and 34 of supporting member 9 are inserted in holes 13A and 13B in Frame legs 11B and 11C, respectively, whereby the supporting member is retained in the frame. Neck 6 of punching bag member 8 is retained by supporting member 9 as heretofore described with reference to FIGS. 5 and 6.

Thus, with punching bag member 2 supported by supporting member 9 and supporting member 9 supported between vertical members 10 via frame 11, arms 50 and 52 and brackets 12 as heretofore described, when body 4 of punching bag member 2 is struck by the user the bag acts much like a conventional punching bag, and when the striking ceases it quickly returns to its normal rest position. Moreover, the punching bag is simple to install and can be installed in a variety of places without elaborate structure required for this purpose.

The adjustable feature of arms 50 and 52 relative to frame 11 accommodates various spaces between vertical members as the case may be. Further the supporting means does not require an elaborate mechanism for accomplishing the purposed intended, as has been the case with other punching bag equipment for like purposes.

Moreover, the resiliency of wire members 18 and 20 may vary, depending upon the strength and age of the user so that more or less resistance is provided when the punching bag member is struck as will be understood by those skilled in the art.

The punching bag apparatus as heretofore described is useful in developing special skills in the boxing arts and developing hand and eye coordination, and hence may be readily adapted to a physical fitness, physical therapy or rehabilitation program as the case may be. The punching bag apparatus disclosed is not intended to replace the conventional punching bag and platform employed by professionals, but is rather intended to provide an economical and simple device to serve the purpose aforenoted.

What is claimed is:

1. Punching bag apparatus and supporting means, comprising:

a punching bag member having a body portion adapted for being struck by a user and a neck portion adapted for engaging a supporting member;

the supporting member including a pair of elongated wire-like members which are twisted together to form a centrally disposed resilient portion for engaging the neck portion of the punching bag member so that said member offers resistance when the body portion thereof is struck by the user and automatically snaps back to the rest position, one of said wire-like members extending in opposite directions from the centrally disposed resilient portion;

the supporting means including the supporting member, a frame for supporting the supporting member, and a pair of arms mounted to the frame and adjustable relative thereto in accordance with the spacing between a pair of vertical members; and means mounted to the vertical members for receiving the adjusted arms to retain the supporting means between the vertical members.

2. Punching bag apparatus and supporting means as described by claim 1, wherein the frame includes:

a base;

a pair of legs extending normal to the base at its ends and adapted for supporting the ends of the supporting member;

a pair of slots carried by the base and extending longitudinally along the base in opposite directions;

each of the arms being aligned with a corresponding slot; and means carried by the arms and engaging the slot for mounting the arms to the frame when the arms are in an adjusted position relative to the frame.

3. Punching bag apparatus and supporting means, as described by claim 2, wherein:

the one of the wire-like members extending in opposite directions from the centrally disposed resilient portions having its ends substantially normal to the wire-like member;

the pair of legs extending normal to the base of the frame and adapted for supporting the ends of the supporting member each having a lip which carries a hole; and the substantially normal ends of the wire-like member being received by the holes in the lips for supporting the ends of the supporting member.

4. Punching bag apparatus and supporting means as described by claim 1, wherein the neck portion of the punching bag member adapted for engaging a supporting member includes:

the neck portion having protrusions extending externally therearound; and the supporting member coacting with the neck portion so that said neck portion snaps into the centrally disposed resilient portion when the elongated wire-like members are forced apart at the centrally disposed resilient portion, and the portions of the elongated wire-like members forming said opening being retained by the external protrusion.

5. Punching bag apparatus and supporting means therefor as described by claim 1, wherein the neck portion of the punching bag member adapted for engaging a supporting member includes:

the neck portion having a flange extending externally therearound; and the supporting member coacting with the neck portion so that said neck portion snaps into the centrally disposed resilient portion when the elongated wire-like members are forced apart at the centrally disposed resilient portion to provide an opening for the neck portion, and the neck portion of the elongated wire-like resilient members forming said opening being retained by the flange.

6. Punching bag apparatus and supporting means therefor as described by claim 1, wherein:

the punching bag type member is a hollow, relatively rigid container like member.

* * * * *